United States Patent [19]

Gadelle et al.

[11] Patent Number: 4,705,431

[45] Date of Patent: Nov. 10, 1987

[54] METHOD FOR FORMING A FLUID BARRIER BY MEANS OF SLOPING DRAINS, MORE ESPECIALLY IN AN OIL FIELD

[75] Inventors: Claude Gadelle, Rueil-Malmaison; Hervé Petit, Vanves, both of France

[73] Assignee: Institut Francais du Petrole, Rueil-Malmaison, France

[21] Appl. No.: 684,297

[22] Filed: Dec. 20, 1984

[30] Foreign Application Priority Data

Dec. 23, 1983 [FR] France ..... 83 20809

[51] Int. Cl.[4] ..... E02D 5/18

[52] U.S. Cl. ..... 405/267; 166/50; 405/52; 405/266

[58] Field of Search ..... 405/267, 52; 166/50, 166/285, 292

[56] References Cited

U.S. PATENT DOCUMENTS

| | | | |
|---|---|---|---|
| 1,430,306 | 9/1922 | Francois | 405/266 |
| 1,884,859 | 10/1932 | Ranney | 166/285 |
| 2,627,169 | 2/1953 | Roulter | 405/267 |
| 2,796,129 | 6/1957 | Brandon | 166/50 X |
| 3,326,003 | 6/1967 | Marconi | 405/267 |
| 3,407,605 | 10/1968 | Coffer et al. | 405/267 X |
| 4,133,383 | 1/1979 | Ely | 166/270 |
| 4,275,788 | 6/1981 | Sweatman | 166/285 X |
| 4,286,676 | 9/1981 | Nguyen et al. | 175/74 |
| 4,311,340 | 1/1982 | Lyons et al. | 405/267 X |
| 4,445,574 | 5/1984 | Vann | 166/50 X |
| 4,446,918 | 5/1984 | Wolcott | 166/50 X |
| 4,510,997 | 4/1985 | Fitch et al. | 166/50 X |

*Primary Examiner*—Dennis L. Taylor

*Attorney, Agent, or Firm*—Antonelli, Terry & Wands

[57] ABSTRACT

The present invention provides a method for injecting a fluid into a geological formation so as to form a barrier of said fluid along a predetermined surface having an elongate shape, the direction of elongation of this surface, or main direction, being distinct from the vertical. Said method consists in injecting said fluid from at least one injection zone of at least one drain passing through said formation, said injection zone being sloping with respect to the vertical and belonging substantially to the surface of the barrier to be formed.

13 Claims, 6 Drawing Figures

METHOD FOR FORMING A FLUID BARRIER BY MEANS OF SLOPING DRAINS, MORE ESPECIALLY IN AN OIL FIELD

BACKGROUND OF THE INVENTION

1. Field of the Invention

The present invention relates to a method for injecting fluid products into a geological formation, with a view more especially to forming a barrier of these fluids in this formation.

The invention may be advantageously used for example for injecting a plugging product into a geological and more especially an oil-bearing reservoir so as to create a sealed isolating barrier which may be disposed substantially vertically if required.

2. Description of the Prior Art

When using oil recovery methods by injecting gaseous fluids, working of the deposit may use several well lines, each line comprising several wells. When the volume of the deposits between these two well lines has been swept, that is to say when a critical value is reached for the composition of the fluids produced, the injection wells are closed and replaced by the former producing wells.

When starting to work a deposit having a non zero dip, the gaseous fluid is generally injected from the top of the structure so as to obtain an optimum sweep. Thus, a gas cap is created whose volume increases with the advance of the line working of the field.

Because of the dip of the layer, the injection pressure for the gaseous fluid increases when injection is stopped from a first well line and when it is effected from a new well line situated downstream of the dip or downside dip, relatively to the first one.

Thus, a part of the gas injected into this new line serves solely for increasing the pressure in the gas cap so that it reaches the injection pressure. This fraction of the gas is therefore lost and cannot contribute to the efficiency of the sweep. As working of the field advances, the amount of gas thus lost increases considerably.

In addition, the continual increase of the pressure of the gas cap with the depth of the injecting well line may lead to creating a pressure which is too high for the mechanical resistance of the mantel of the deposit. A rupture in this mantel causes considerable losses of gas, adversely affecting the economy of the process and possibly creating considerable pollution. This phenomenon is all the more important the shallower the deposit.

The need to limit these gas losses leads to attempting to isolate, from a certain volume, the gas cap from the rest of the deposit; working would then be continued with the creation of a new gas cap which, when desired, could also be isolated from the unworked part of the deposit.

The prior art may be illustrated by U.S. Pat. Nos. 3,380,522; 4,326,818, and 4,289,354.

The first patent concerns a method for preventing salt water from penetrating into a soft water reservoir. The second patent describes water storage techniques and the third patent teaches a method for working a solid mineral such as coal.

None of these documents relates, in particular, to the formation of a barrier from horizontal drains. Such horizontal drains may be provided by use of apparatus as described in U.S. Pat. No. 4,286,676.

SUMMARY OF THE INVENTION

Generally the present invention relates to a method for injecting a fluid into a geological formation so as to form a barrier of this fluid along a predetermined surface having an elongate shape, the direction of elongation of this surface, or main direction, being distinct from the vertical direction.

The method of the invention is characterized in that the fluid is injected from at least one injection zone of at least one drain passing through the formation, said injection zone being sloping with respect to the vertical and belonging substantially to the surface of the barrier to be formed.

In the rest of the description, when mention is made of fluid or injected fluid and injection drains without any other explanation, it will be a question respectively of the fluid or product serving for forming the barrier and of drains serving for injecting this fluid.

An injection drain may comprise several injection zones.

The injection zone may be substantially parallel to said main direction of the barrier to be formed.

It is possible in accordance with the invention to inject the fluid from several different injection zones belonging possibly to different drains and located substantially on the surface defining the barrier to be formed.

When the fluid is injected from these two injection zones belonging to two different drains, it is possible for these injection zones to be substantially parallel to each other.

When several injection zones are used, they may be equidistant from each other over at least a portion of their length. This variant is particularly advantageous for it allows injection zones to be used under optimum conditions, at least for a homogeneous geological formation.

It is also advantageous to situate the peripheral injection zones (the term peripheral is used for designating the injection zones the closest to the enveloping formations) at a distance from the edge of the barrier slightly less than the optimum penetration distance into the formation fo the fluid to be injected.

The amount of fluid injected through each of these zones may depend on the shape to be given to the barrier. Thus, if a greater barrier thickness is desired at a given level of the formation, an amount of fluid will be injected into the injection zone or the injection zones the closest to said level, which is greater than that injected through the other zones, at least if the drains are equidistant.

Still within the scope of the invention, the line amount injected along a drain may be modulated.

Thus, the problem set by not respecting the parallelism between two adjacent injection drains intended to form a barrier at least partially may be solved.

In this case, the line amount injected through at least one of these drains may vary by taking into consideration the distance separating these two drains.

The overall amount of fluid injected through a zone situated substantially at the center of the barrier may be greater than that injected through an injection zone situated substantially at the periphery of the barrier.

The distances separating injection zones belonging to different drains situated at the center of said barrier may be greater than the distances separating the injection zones belonging to different drains situated substantially at the periphery of the barrier.

Still within the scope of the invention, one or more wells may be used drilled from the surface so as to form one or more drains. The same well may branch into several drains.

Again within the scope of the invention, the passage sections for injecting the fluid may be varied along injection portions or zones, or by injecting this fluid simultaneously from at least two injection portions.

For working an oil deposit, it may be advantageous to dispose a barrier so that the elongation direction corresponds to an isobath line at least if the shape of the deposit permits it.

BRIEF DESCRIPTION OF THE DRAWINGS

The present invention will be better understood and its advantages will appear from the following description of a particular embodiment, which is in no wise limitative, illustrated by the accompanying schematic figures in which.

DESCRIPTION OF THE PREFERRED EMBODIMENT

The example described hereafter concerns the positioning of plugging product barriers in the case of working an oil field by means of wells drilled in lines. The injection drains used are horizontal but, still within the scope of the invention, they may be in another direction which is sloping with respect to the vertical.

Figure 1:
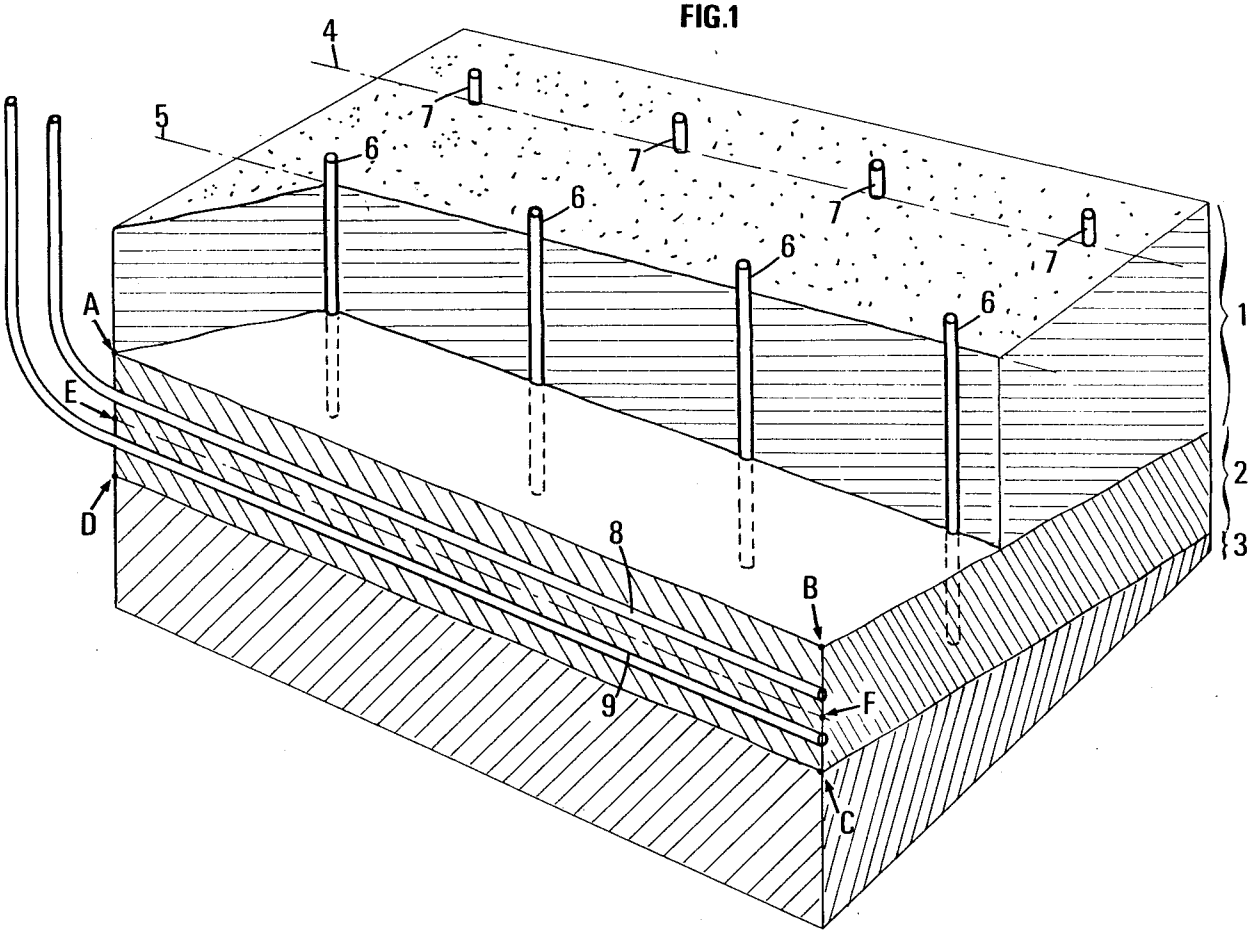
FIG. 1 shows the arrangement of substantially horizontal drains in the oil field.

FIG. 1 shows three geological formations referenced respectively 1, 2 and 3.

Layer 2 is the one which contains the oil and in which it is desired to place a barrier, layer 1 forms the upper wall and layer 3 the lower wall of the reservoir.

It is desired to position in these formations a barrier following the surface defined by the four points A B C D in FIG. 1 (E F designates the main direction in which the barrier extends). For this, two substantially horizontal drains have been superimposed in layer 2 parallel to lines 4 and 5 of the oil field working wells 6 and 7, which two drains are intended for positioning plugging agents in a substantially vertical slice of the deposit A B C D.

The length of the horizontal drains 8 and 9 may depend on the length of the barrier to be formed. Consecutive drains may also be used. The number of superimposed horizontal drains may depend on the thickness AD of the layer and may go from one for a layer of small thickness to several for thick layers.

Figure 2:
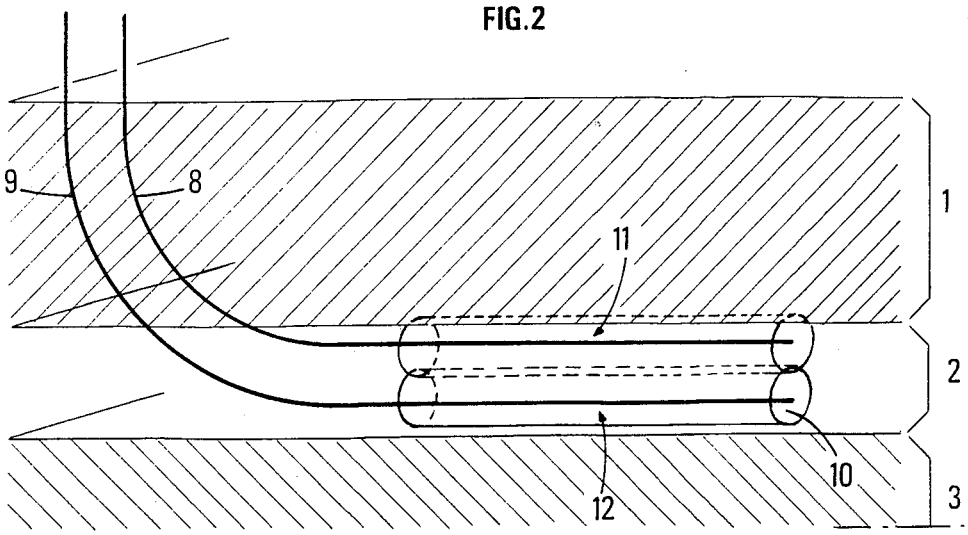
FIG. 2 shows the penetration of the fluid or product injected.

In order to efficiently plug the zone to be isolated, it is necessary to introduce the plugging product 10 in a homogeneous way along the drain, at least if the two drains are parallel to each other, as is shown in FIG. 2.

When the zones 11 and 12 invaded by the plugging product injected into the horizontal drains have joined up and have reached the roof and the wall of the layer, the defined zone will be isolated from the rest of the deposit.

Because of the viscosity of the products injected, a pressure gradient is created in the horizontal drain. In order to ensure progressive and homogeneous invasion of the vertical section, it is important for the amounts injected at any point in the drain to be identical. For that, the sections of the perforations or slots of the injection portions may be possibly increased from upstream to downstream of the drain (considering the fluid flow direction).

The products which may be used for providing a permanent plug may be sodium silicate base mixtures for example which, when they are agitated, have a low viscosity of the order of that of water and which gel after a certain rest time. The low viscosity of the initial product allows considerable invasion of the formation and an efficient plugging action when the product gels.

It is obvious that the composition of the mixture injected depends on the nature of the formation (sandstone, limestone, the presence of more or less permeable zones) and on the temperature.

The use of resins or polymers such as polyacrylamides also allow permanent plugs to be obtained.

Still within the scope of the invention, other products may be used having plugging or blocking properties.

The number of superimposed horizontal wells depends on the flow conditions in a drain, in particular on the viscosity of the products injected and on the time required for compact mass setting thereof in the deposit.

The maximum distance between two adjacent drains is equal to the maximum diameter which it is possible to plug from one drain (tangent plugged cylinders (FIG. 2)). But it is preferable for the drains to have lesser spacing than that defined above, so that the thickness of the barrier in the direction perpendicular to plane A B C D is sufficiently large.

Figure 3:
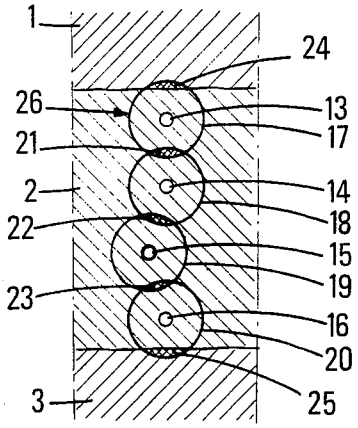
FIG. 3 illustrates the case of substantially equi-distant drains.

This is illustrated in FIG. 3 which is a sectional view of the geological formations 1, 2 and 3 along a vertical plane substantially perpendicular to the injection drains 13, 14, 15 and 16. Each of the circles 17, 18, 19 and 20 represents the ideal maximum zone invaded by the product injected from each of the drains 13–16, if this latter were the only one to inject this product. The hatched surfaces 21, 22 and 23 correspond to overlapping of the invasion zones.

This overlapping guarantees not only a certain thickness of the plugging barrier but also a certain tolerance in the positioning of the drains, as can be seen in the figure.

In fact, although drain 15 is not in the plane defined by drains 14 and 16, there is nevertheless overlapping of the fluid injected through drains 14 to 16 (FIG. 3, zones 22 and 23).

Zones 24 and 25 correspond to overlapping of the product injected through the peripheral drains with the geological formations 1 and 3 enveloping the formation in which it is desired to create the barrier 26.

If formations 1 and 3 are impermeable to the product injected, this product will spread in formation 2 at the interfaces between formations 1 or 3 and formation 2.

Still within the scope of the present invention, different distances may be provided between the drains, particularly when the porosity of the geological formation 2 is not homogeneous.

Furthermore, it is preferable for injection of the plugging agent to take place simultaneously in the different superimposed drains 13 to 16 so as to obtain better interpenetration of the plugged zones, particularly when the injected product is of the quick setting type.

The following example shows the advantage of the isolating method of the present invention.

Figure 4:
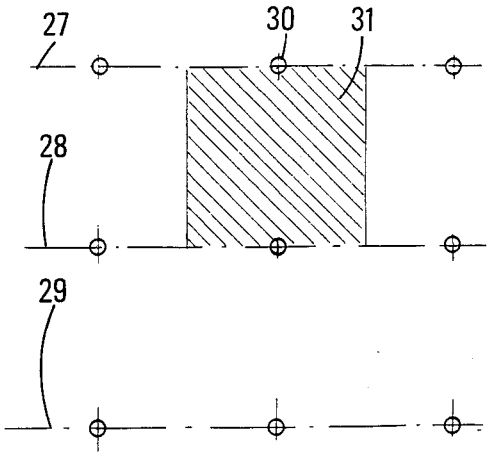
FIG. 4 shows a method of working a field by means of several wells disposed in a line.

Let us take a deposit situated at a depth of 100 m having a thickness of 10 m and a dip equal to 15°. The porosity is 30%. The oil and water saturations are 90% and 10%; the oil is heavy oil of a density equal to 0.95. The deposit is worked in lines by in situ combustion. The volume invaded by the gas is 50% of the pore volume. The wells are spaced apart by 100 m (FIG. 4, top view of the field to be worked).

During passage of the air injected for combustion from the well line 27 to the well line 28, the pore volume invaded by the gas injected through a well 30 corresponding to the hatched zone 31 is 15,000 $m^3$. If the instantaneous injection pressure is equal to the hydrostatic pressure corresponding to the depth of the combustion front, it is therefore 10 bars when the front is on line 27 whereas it must be 12.7 bars when the combustion reaches line 28.

The volume of gas contained in the hatched zone 31 is 190,500 $Nm^3$ when the injection of gas is transferred to the well line 28.

During working between line 28 and line 29, the pressure increases from 12.7 to 15.4 bars and a volume of 40,500 $Nm^3$ serves for pressurizing the previously swept zone from 12.7 to 15.4 bars; 231,000 $Nm^3$ of gas remain trapped in the hatched zone between line 27 and line 28.

Working between lines 27 and 28 causes a gas loss of 190,500 $Nm^3$; that between line 28 and 29 causes a total loss of 271,500 $Nm^3$. By continuing the procedure, the gas loss may be calculated for the different working lines and the increase in the injection pressure.

| ZONES | P INJECTION | GAS VOLUME | % used for pressurizing the preceding zones |
|---|---|---|---|
| 1st (27–28) | 10–12.7 bar | 190,500 $Nm^3$ | 0 |
| 2nd (28–29) | 12.7–15.4 bar | 271,500 $Nm^3$ | 15% |
| 3rd (29–) | 15.4–18.1 bar | 352,500 $Nm^3$ | 23% |
| 4th | 18.1–20.8 bar | 433,500 $Nm^3$ | 28% |
| 5th | 20.8–23.5 bar | 514,500 $Nm^3$ | 31.5% |

It can be seen that during working of the fifth zone, a third of the gas lost serves for recompressing zones already worked.

Furthermore, the pressure reigning in the swept zones is 23.5 bar; the pressure at the top of the formation is substantially greater than the hydrostatic pressure, it comes close to and may even in some cases exceed the lithostatic pressure, causing risks of rupture of the mantel covering the deposit. The need for completely isolating the zones already swept can therefore by clearly seen. A barrier between the 3rd and 4th zones or between the 4th and 5th zones seems judicious.

Figure 5:
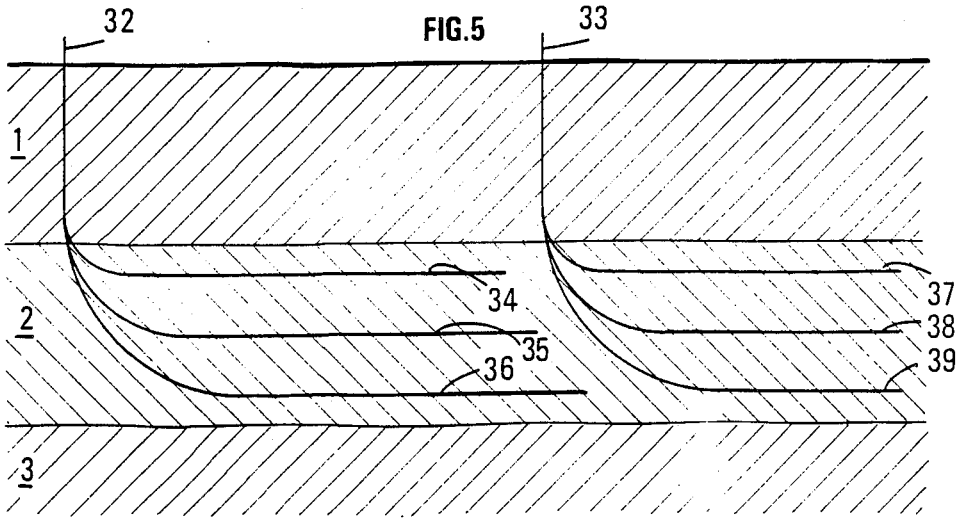
FIGS. 5 and 6 show possible arrangements of the drains in a geological formation.
Figure 6:
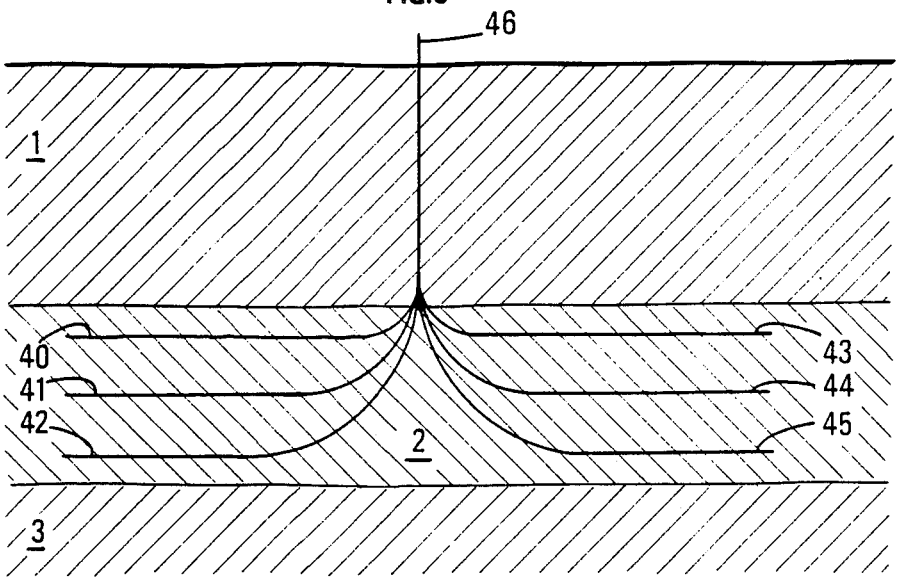

FIGS. 5 and 6 show two variants for positioning drains when these latter are drilled from the surface.

In the case of FIG. 5, the barrier is formed from two wells 32 and 33 drilled from the surface and which branch out into several drains respectively 34, 35 and 36, and 37, 38 and 39.

In the case of FIG. 6, only a single well 46 is used which branches out into several drains 40 to 45 in both directions of the barrier.

Still within the scope of the present invention, the production well lines 4 and 5 or gas injection lines 6 and 7 may comprise sloping drains.

Moreover, if such be the case, these sloping wells may be used for injecting a fluid for forming the barrier to be created.

What is claimed is:

1. A method for injecting a fluid into a geological formation to form a barrier of said fluid across a predetermined surface having an elongated shape, the direction of elongation of this surface, or main direction, being distinct from the vertical, wherein said fluid is injected from a plurality of injection zones provided by a plurality of drains passing through said formation in a substantially horizontal direction, said drains being arranged vertically one above the other to provide a substantially planar barrier across the geological formation and the drains being drilled from the surface.

2. The method as claimed in claim 1, wherein said injection zones are substantially parallel to said main direction of the barrier to be formed.

3. The method as claimed in claim 1, wherein said fluid is injected from different injection zones belonging to different drains and said injection zones belong substantially to the barrier to be formed.

4. The method as claimed in claim 1, wherein said fluid is injected from at least two injection zones belonging to two different drains, and said injection zones are substantially parallel to each other.

5. The method as claimed in claim 3, wherein said drains are substantially equidistant form each other over at least a portion of their length.

6. The method as claimed in claim 3, wherein the distances separating said drains depend on the shape of the barrier.

7. The method as claimed in claim 3, wherein the distances separating injection zones belonging to different drains situated substantially at the center of said barrier are greater than the distances separating the injection zones belonging to different drains situated substantially at the periphery of said barrier.

8. The method as claimed in claim 3, wherein amount of fluid injected through each of said zones depends on the shape of the barrier.

9. The method as claimed in claim 3, wherein the injection of an amount of fluid greater than that injected from at least one injection zone situated at the periphery of said barrier is effected from at least one injection zone situated substantially at the center of the barrier.

10. The method as claimed in claim 1, wherein said fluid injected is a plugging fluid.

11. The method as claimed in claim 3, wherein injection zones are disposed so as to form a substantially flat barrier.

12. The method as claimed in claim 1, wherein drains are used offering to said fluid a passage section which increases from upstream to downstream.

13. The method as claimed in claim 3, wherein said fluid is injected simultaneously from at least two drains.

* * * * *